US005860038A

United States Patent [19]

Kato et al.

[11] Patent Number: 5,860,038

[45] Date of Patent: Jan. 12, 1999

[54] APPARATUS AND METHOD FOR DETECTING DEVELOPING ABILITY OF AN IMAGE FORMING APPARATUS

[75] Inventors: Shinji Kato, Kawasaki; Kouta Fujimori; Takayuki Maruta, both of Yokohama, all of Japan

[73] Assignee: Ricoh Company, Ltd., Tokyo, Japan

[21] Appl. No.: 864,691

[22] Filed: May 28, 1997

[30] Foreign Application Priority Data

May 28, 1996 [JP] Japan ..... 8-132900

[51] Int. Cl.[6] ..... G03G 15/00

[52] U.S. Cl. ..... 399/49; 399/74; 250/205; 250/559.1

[58] Field of Search ..... 399/49, 59, 60, 399/74; 356/445; 250/205, 559.1

[56] References Cited

U.S. PATENT DOCUMENTS

| | | | |
|---|---|---|---|
| 4,550,254 | 10/1985 | Zomorrodi et al. | 250/338.1 |
| 5,237,369 | 8/1993 | Maruta et al. . | |
| 5,293,198 | 3/1994 | Sawayama et al. . | |
| 5,298,944 | 3/1994 | Sawayama et al. . | |
| 5,327,196 | 7/1994 | Kato et al. . | |
| 5,387,965 | 2/1995 | Hasegawa et al. . | |
| 5,424,809 | 6/1995 | Sawayama et al. . | |
| 5,475,476 | 12/1995 | Murai et al. . | |
| 5,600,445 | 2/1997 | Omi . | |

FOREIGN PATENT DOCUMENTS

| | | |
|---|---|---|
| 3-206471 | 9/1991 | Japan . |
| 4-14059 | 1/1992 | Japan . |
| 4-60567 | 2/1992 | Japan . |

*Primary Examiner*—Joan H. Pendegrass
*Attorney, Agent, or Firm*—Oblon, Spivak, McClelland, Maier & Neustadt, P.C.

[57] ABSTRACT

An image forming apparatus includes an photoconductive drum, a charger, an exposing device, a developing device and a transferring device. A photo-sensor is disposed around the photoconductive drum. The photo-sensor senses the intensity of the reflected light from the surface of the photoconductive drum and the reflected light from the reference toner image formed on the photoconductive drum. The intensity of the emitted light from photo-sensor is changed corresponding to a continuous lighting time of the photo-sensor. Therefore, the intensity is compensated in response to the continuous lighting time of the photo-sensor. As a result, accurate toner density is detected.

18 Claims, 10 Drawing Sheets

57

| NO. | Vmax | VD | VB | VL |
|---|---|---|---|---|
| 1 | 160 | 400 | 260 | 110 |
| 2 | 180 | 429 | 286 | 118 |
| 3 | 200 | 457 | 311 | 126 |
| 4 | 220 | 486 | 337 | 133 |
| 5 | 240 | 514 | 363 | 141 |
| ⋮ | ⋮ | ⋮ | ⋮ | ⋮ |
| 16 | 460 | 829 | 646 | 226 |
| 17 | 480 | 857 | 671 | 234 |
| 18 | 500 | 886 | 697 | 241 |
| 19 | 520 | 914 | 723 | 249 |
| 20 | 540 | 943 | 749 | 257 |

*FIG. 12*

APPARATUS AND METHOD FOR DETECTING DEVELOPING ABILITY OF AN IMAGE FORMING APPARATUS

CROSS REFERENCES TO RELATED APPLICATIONS

This application claims priority to Japanese Patent Application No. 8-132900 filed May 28, 1996 and is related to U.S. patent application Ser. No. 08/584,443 filed Jan. 11, 1996, U.S. patent application Ser. No. 08/585,630 filed Jan. 16, 1996, U.S. Pat. No. 5,387,965 filed Feb. 7, 1995, U.S. Pat. No. 5,327,196 filed Jul. 5, 1994, U.S. Pat. No. 5,293,198 filed Mar. 8, 1994, U.S. patent application Ser. No. 08/581,922 filed Jan. 2, 1996, U.S. Pat. No. 5,600,445 filed Feb. 4, 1997, U.S. Pat. No. 5,237,369 filed Aug. 17, 1993, U.S. patent application Ser. No. 08/432,767 filed May 2, 1995, U.S. Pat. No. 5,475,476 filed Dec. 12, 1995, U.S. Pat. No. 5,424,809 filed Jun. 13, 1995, and U.S. Pat. No. 5,298,944 filed Mar. 29, 1994, all of which are incorporated herein by reference.

BACKGROUND OF THE INVENTION

1. Field of the Invention

The present invention relates to an image forming apparatus such as a copier, a printer, a facsimile machine or similar electrophotographic image forming apparatus, and more particularly, the invention relates to a method and an apparatus for detecting developing ability of an image forming apparatus.

2. Discussion of Background

It is necessary for a conventional image forming apparatus to detect its own developing ability precisely. In order to detect developing ability of the image forming apparatus, intensity (A) of reflected light from the surface of an image bearing member, such as a photoconductive member or an intermediate transfer belt, and intensity (B) of reflected light from a reference toner image are detected by a photo-sensor. A ratio of intensities A and B is calculated (i.e. ratio=A/B), and the calculated ratio is compared to a reference value. As a result of this ratio calculation, a developing ability, such as toner adhering quantity on the image bearing member, is detected. In order to maintain a good image quality, image processing devices of the image forming apparatus, such as a charger, an exposure device, a developing device, etc. are controlled in response to the calculated ratio (i.e., developing ability).

Japanese Laid-Open Patent No. 04-60567 discloses a toner density control device in which a light-emitting device, such as a light-emitting diode, emits light only when the reflected light from the surface of the photoconductive drum is detected in order to extend the life of the light-emitting device and to prevent fatigue of the photoconductive member. The intensity of light of the light-emitting device varies corresponding to the continuous lighting time of the light-emitting diode. Namely, the intensity of light of the light-emitting diode decreases after the intensity of light reaches a maximum, since internal resistant value increases corresponding to an increase of internal temperature of the light-emitting diode. As a result, a detecting voltage of the toner pattern varies in response to the continuous lighting time of the light-emitting diode even if the density of the toner pattern is the same.

SUMMARY OF THE INVENTION

Accordingly, it is an object of the present invention to provide a novel image forming apparatus that can detect developing ability precisely.

It is another object of this invention to provide a novel image forming apparatus in which toner is not adhered on the surface of an image bearing member when intensity of the reflected light from the surface of the image bearing member is detected.

The above and other objects are achieved according to the present invention by providing a new and improved image forming apparatus for forming a toner image of an object image on a sheet of paper including an image bearing means; means for forming an image on the image bearing means; means for emitting light on the object image; means for receiving reflected light from the object image; means for detecting the intensity of the reflected light; means for compensating the detected intensity based on a continuous lighting time of the emitting means; and means for controlling the image forming means in response to the compensated detected intensity.

According to a second aspect of the present invention there is provided an image forming apparatus including an image bearing means; means for forming a first image and a second image which is different from the first image on the image bearing means; means for emitting light on the first image and the second image in which continuous lighting times applied by the emitting means to the first image and to the second image are different from each other; means for receiving reflected light from the first image and from the second image; means for detecting first and second intensities corresponding to the reflected light from the first and second images, respectively; means for compensating the second detected intensity based on the continuous lighting time of the emitting means; and means for controlling the image forming means in response to the first intensity and the compensated second intensity.

According to a third aspect of the present invention there is provided an image forming apparatus including an photoconductive member; an image forming device which forms an image on the photoconductive member; a photo-sensor including light a emitting diode which emits light to and receives reflected light from the photoconductive member; circuitry which compensates an intensity value detected by the photo-sensor based on a continuous lighting time of the light emitting diode; and a controller which controls the image forming device in response to the compensated intensity value.

According to a fourth aspect of the present invention there is provided an image density control method, including the steps of forming an image on an image bearing device; emitting light on an object image; receiving reflected light from the object image; detecting an intensity of light reflected from the object image; compensating the detected intensity based on a continuous lighting time of the emitted light and generating a compensated value; and controlling an image formation on the image bearing device in response to the compensated value.

According to a fifth aspect of the present invention there is provided a computer program product including a computer storage medium and a computer program code mechanism embedded in the computer storage medium for causing a computer to control an image density, the computer program code mechanism including a first computer code segment configured detect an intensity of light reflected from an object image; a second computer code segment configured to compensate the detected intensity based on a continuous lighting time of light emitted on an object image and to generate a compensated value; and a third computer code segment configured to control an image formation on an image bearing device in response to the compensated value.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 12 is a table for determining the control voltage of the process devices of the image forming apparatus.

DESCRIPTION OF THE PREFERRED EMBODIMENTS

Figure 1A:
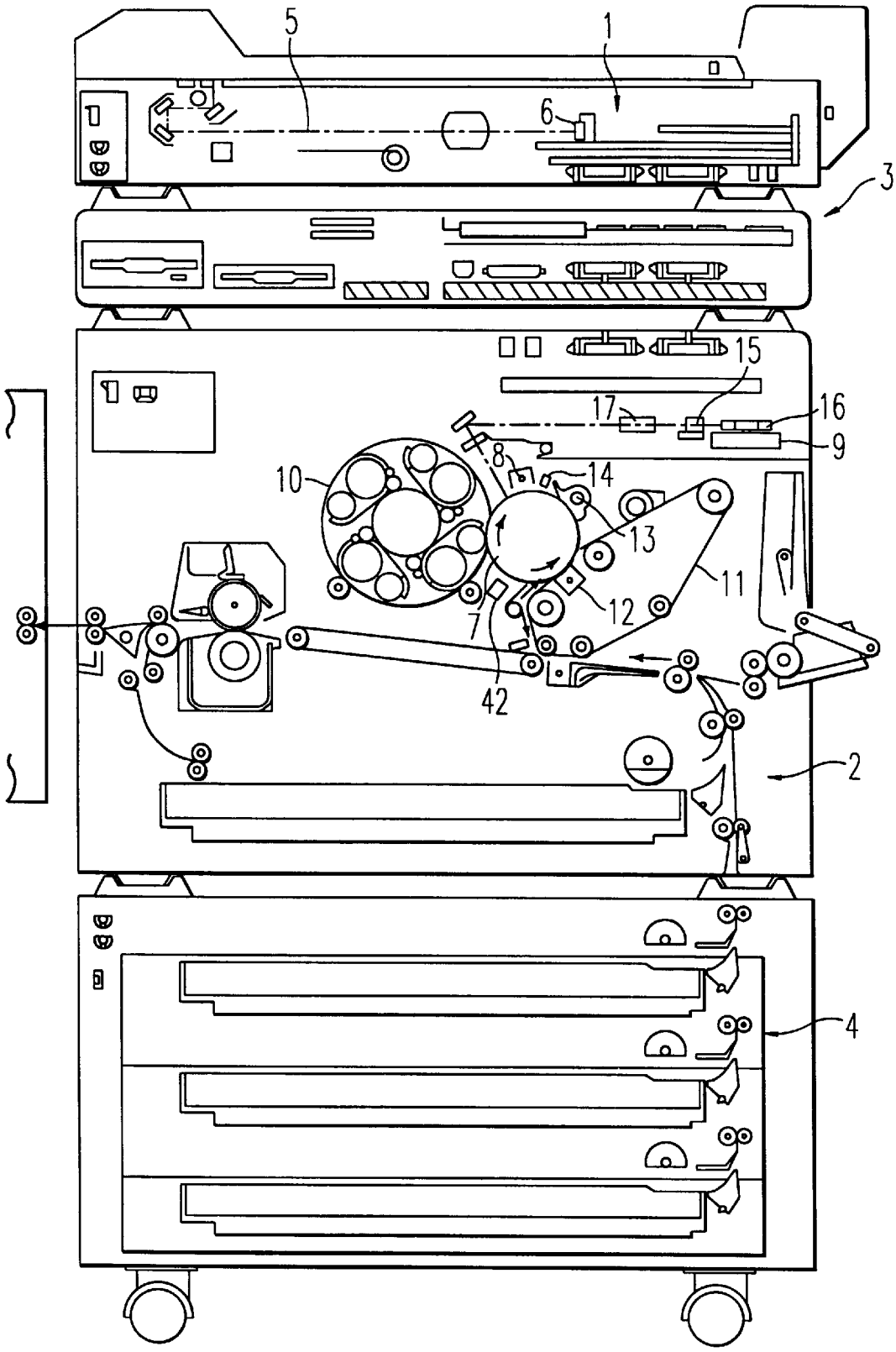
FIG. 1A is a front sectional view of a color image forming apparatus of the present invention.

Referring now to the drawings, wherein like reference numerals designate identical or corresponding parts throughout the several views, and more particularly to FIG. 1A thereof, a digital color copier embodying the present invention is shown and includes a scanner unit 1, a printer unit 2, a system control unit 3 and a paper feeder unit 4. The digital color copier is a multi-function copier that not only includes copying function but also includes facsimile function and printing function.

Figure 1B:
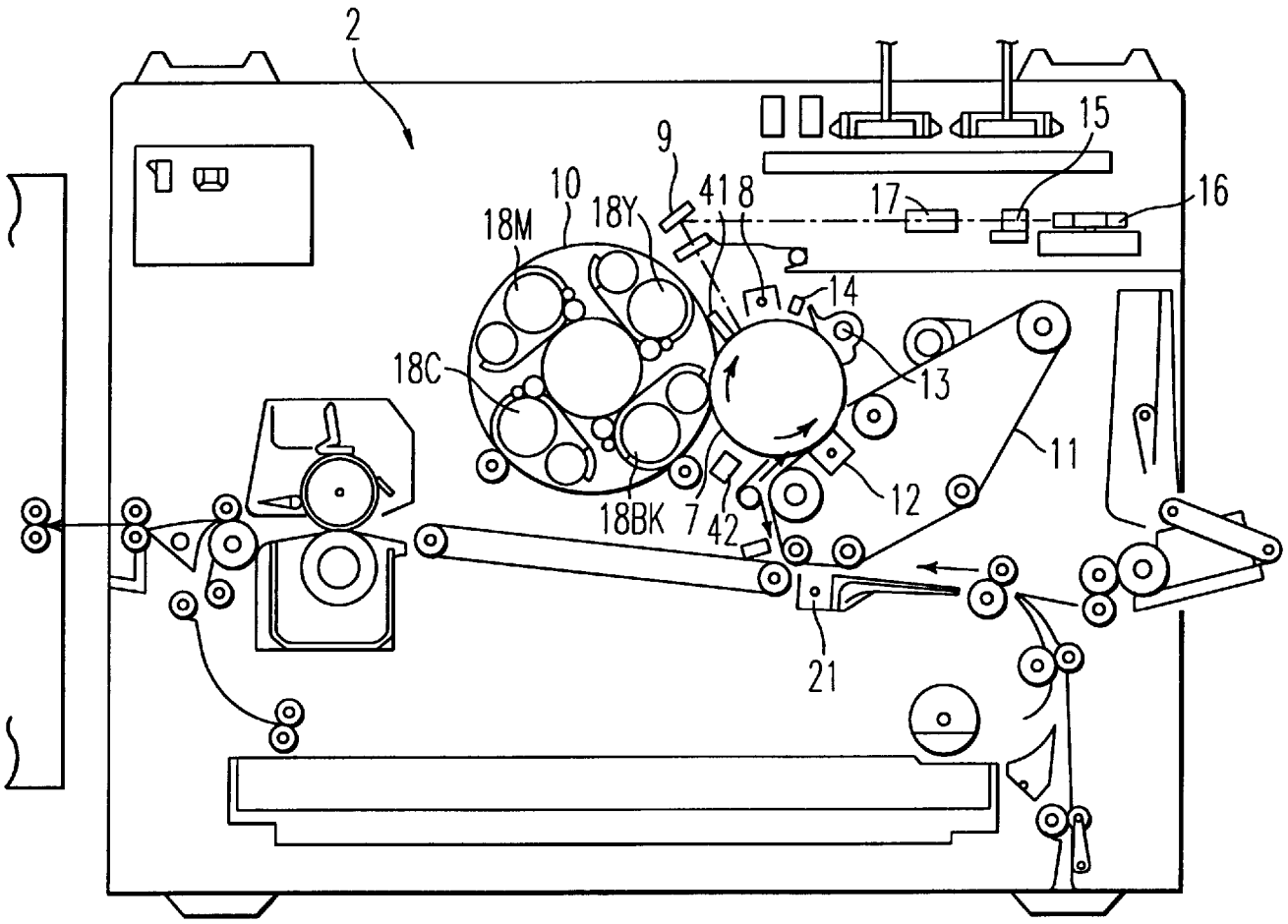
FIG. 1B is a front sectional view of a printer unit of the color image forming apparatus of FIG. 1A of the present invention.

The scanner unit 1 includes an optical scanner 5 and a CCD line sensor 6. The optical scanner 5 scans a color image and the scanned color image is divided into three color images, RGB (Red, Green and Blue), by the CCD line sensor 6. Each divided color image, RGB, is converted into black, cyan, magenta and yellow images respectively. The intermediate transfer belt 11 is supported by a few rollers and rotates in a clockwise direction. The belt 11 is made of ETFE, and the surface resistant value of the belt is in the range of $10^8$ Ω/cm$^2$ to $10^{10}$ Ω/cm$^2$. In FIG. 1B, the printer unit 2 includes a photoconductive drum 7 and the following elements disposed around the photoconductive drum 7: a charger 8, an optical writing device 9 which includes a laser 15, a polygonal mirror 16 and f-θ lens 17, a revolving type developing device 10, an intermediate transfer belt 11, a first transfer charger 12, a second transfer charger 21, a cleaning device 13, a discharging lamp 14, a surface voltage detecting sensor 41, and a photo-sensor 42 which includes a light-emitting diode and a light-receiving element.

Figure 2:
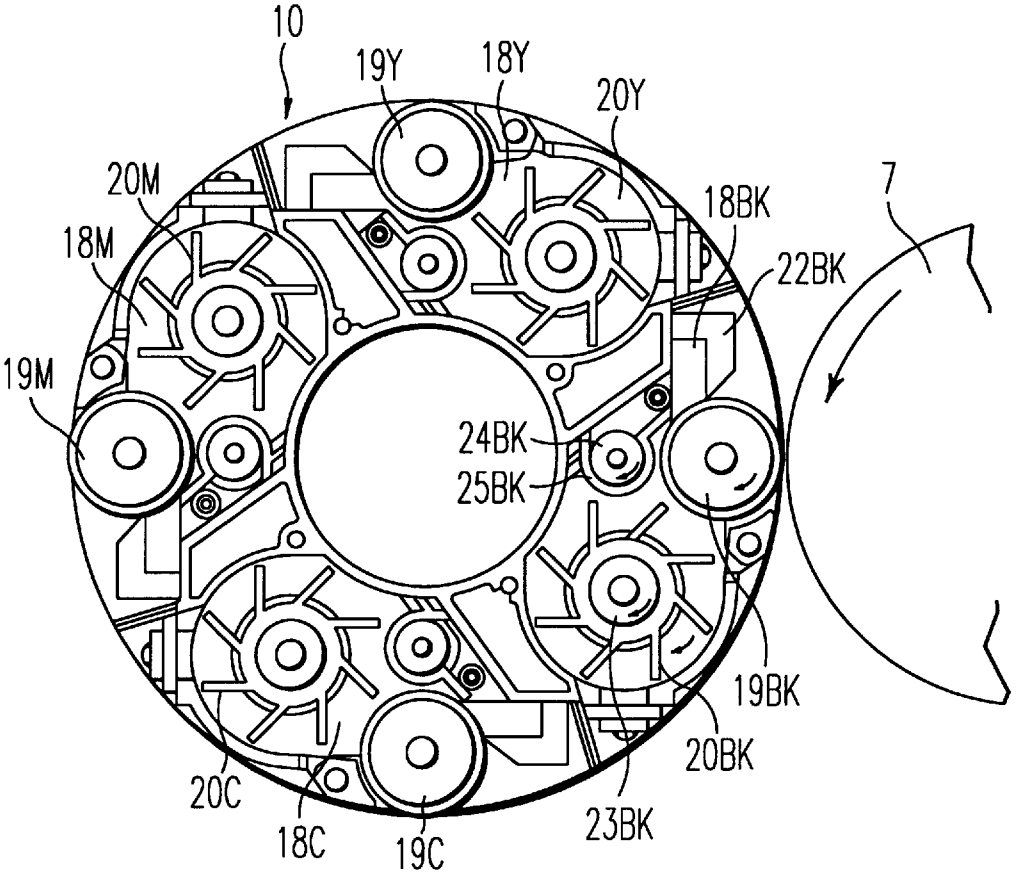
FIG. 2 a fragmentary front sectional view of a revolving type developing device of the present invention.

In FIG. 2, the revolving type developing device 10 includes a black developing device 18BK, a cyan developing device 18C, a magenta developing device 18M and an yellow developing device 18Y. The developing device 10 further includes developing sleeves 19BK, 19C, 19M and 19Y which rotate while carrying developer on the sleeve to develop an electrostatic latent image on the photoconductive drum 7, and developing paddles 20BK, 20C, 20M and 20Y which draw up and mix the developer. The black developing device 10BK is positioned facing the photoconductive drum 7 before the copying operation is started.

In operation, in response to a copy start signal, the photoconductive drum 7 rotates and the surface of the photoconductive drum 7 is charged by the charger 8 (see FIGS. 1A–2). The optical scanner 5 scans the color image and the CCD line sensor 6 reads the black image first. The laser beam which corresponds to the black image is written on the photoconductive drum 7 and the electrostatic latent image corresponding to the black image is thus formed thereon. The black developing sleeve 19BK starts its rotation before a leading edge of the black electrostatic latent image reaches the developing area, and the black electrostatic latent image is developed. When the rear edge of the black electrostatic latent image passes through the developing area, the revolving type developing device 10 rotates immediately and the cyan developing device 18C is positioned so as to face the photoconductive drum 7 before the cyan electrostatic latent image faces to the developing area.

Each developing device 18BK, 18C, 18M and 18Y is a two component developing device that includes toner and ferrous carrier. The toner is charged to a negative polarity by frictional charge between the toner and the ferrous carrier. A developing DC bias voltage of negative polarity and an AC voltage are supplied to the developing sleeves 19BK, 19C, 19M and 19Y. Therefore, each respective black, cyan, magenta, and yellow toner adheres to the area on the photoconductive drum 7 where the laser beam is written. Each toner image on the photoconductive drum 7 is successively transferred to the intermediate transfer belt 11 by means of the first transfer charger 12. In this way, a composite toner image which includes a black, a magenta, a cyan and an yellow toner images is formed on the intermediate transfer belt 11. The composite toner image is transferred to a sheet of paper which is fed from the paper feeder unit 4 by means of the second transfer charger 21. The composite toner image is fixed on the sheet of paper by means of a fixing device 22.

Figure 3:
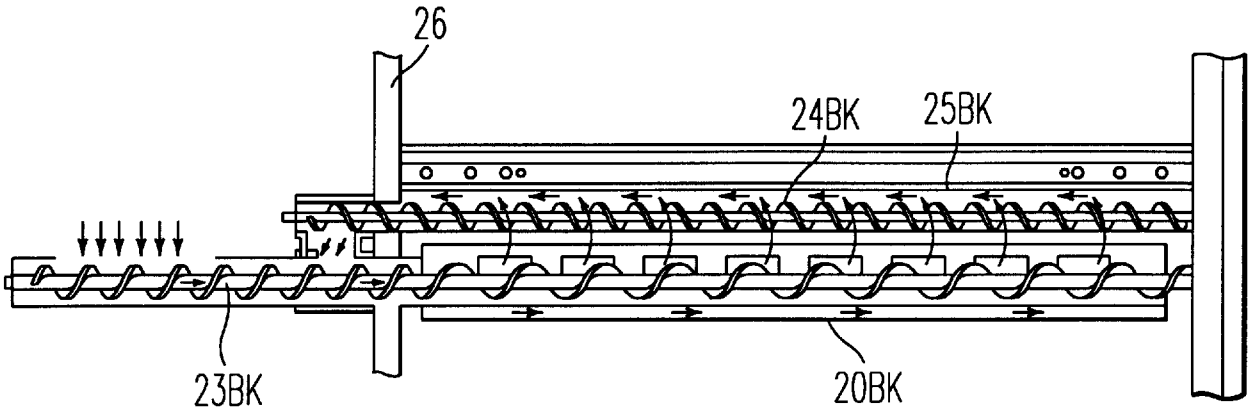
FIG. 3 shows a developer transporting and mixing mechanism of a black developing device of the present invention.

The method of mixing the developer in the revolving type developing device 10 will now be explained. Referring to FIGS. 2 and 3, the revolving type developing device 10 includes the black developing device 18BK, the cyan developing device 18C, the magenta developing device 18M and the yellow developing device 18Y. The revolving type developing device 10 rotates around its center. The operation of the developing devices 18C, 18M, and 18Y will now be described with reference to the operation of black developing device 18BK (FIGS. 2 and 3) since all of the developing devices operate in a similar manner. The black developing device 18BK includes the developing sleeve 19BK, a doctor blade 22BK which regulates the thickness of the developer on the developing sleeve 19BK, the developing paddle 20BK, a screw paddle 23BK, a screw 24BK and a screw case 25BK. The developer which includes the toner and the ferrous carrier is transported in a direction designated by arrows and the toner and the ferrous carrier are mixed in the black developing device 18BK as shown in FIG. 3. The developer in the screw case 25BK is transported by the screw 24BK and the developer is dropped on the screw paddle 23BK after passing through a front side plate 26. Then the developer is transported by the screw paddle 23BK. The developing sleeve 19BK draws up the developer that is on the developing paddle 20BK, and transports the developer to the developing area. The developer layer on the developing sleeve 19BK is regulated by the doctor blade 22BK, and the surplus developer that is regulated by the doctor blade 22BK falls into the screw case 25BK.

Figure 4:
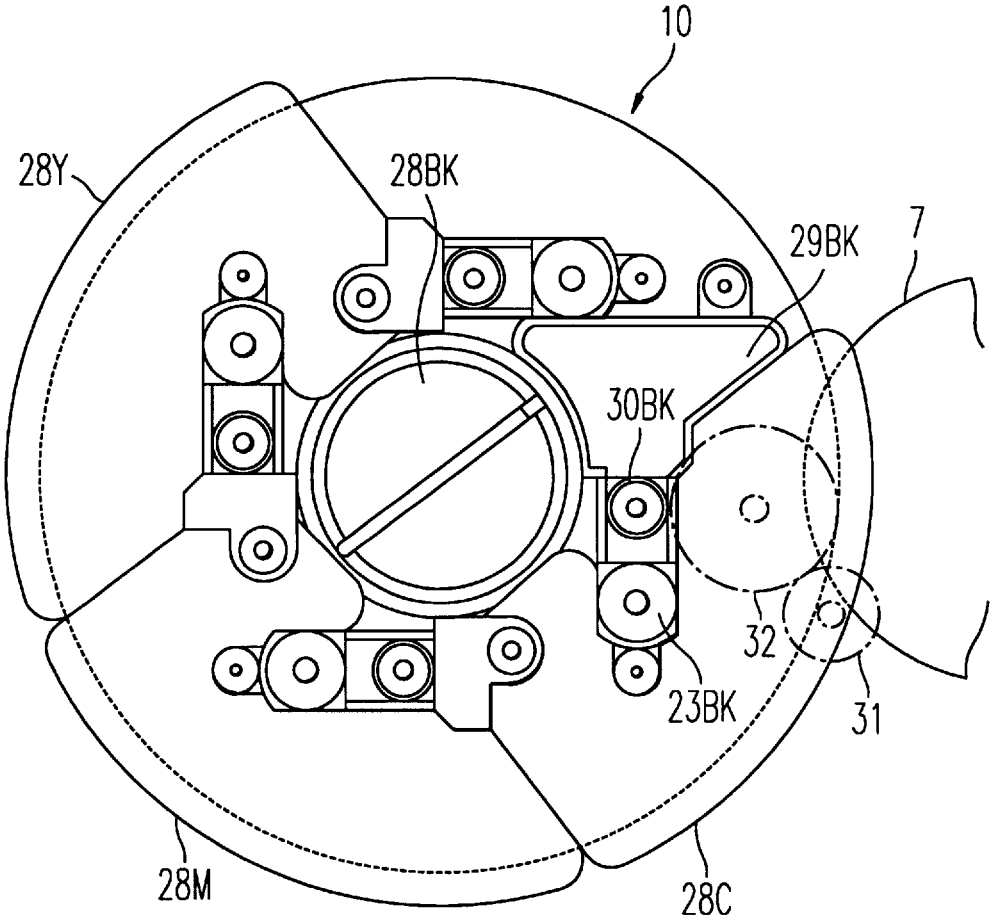
FIG. 4 shows a toner replenishing mechanism of the revolving type developing device of the present invention.

FIG. 4 shows a toner replenishment mechanism of the revolving type developing device 10. Referring to FIG. 4, the revolving type developing device 10 includes a black toner cartridge 28BK, a cyan toner cartridge 28C, a magenta toner cartridge 28M and an yellow toner cartridge 28Y. The cyan, magenta and yellow toner cartridges 28C, 28M and 28Y are fan-shaped cartridges and are disposed at the left side of the front side plate 26 of FIG. 3 (i.e., the toner cartridges 28C, 28M and 28Y are disposed at a front side of the digital color copier). The black toner cartridge 28BK is a cylindrical toner cartridge having a length with respect to the axial direction the same as that of the revolving type developing device 10 and is disposed at the center of the revolving type developing device 10. The black toner in the black toner cartridge 28BK is replenished to a toner hopper 29BK when the revolving type developing device 10 rotates. A toner replenishing roller 30BK is disposed between the toner hopper 29BK and the screw paddle 23BK. The toner replenishing roller 30BK is driven by a motor 31 and a gear 32. When the motor 31 is driven, the rotation force is transmitted to the toner replenishing roller 30BK via the gear 32 and then the black toner in the hopper 29BK is replenished to the screw paddle 23BK. The toner is then transported by the screw paddle 23BK. The toner cartridges 28C, 28M and 28Y are replenished from respective cyan, magenta, and yellow toner hoppers and operate in a similar manner as the black developing device 28BK described above.

Figure 5:
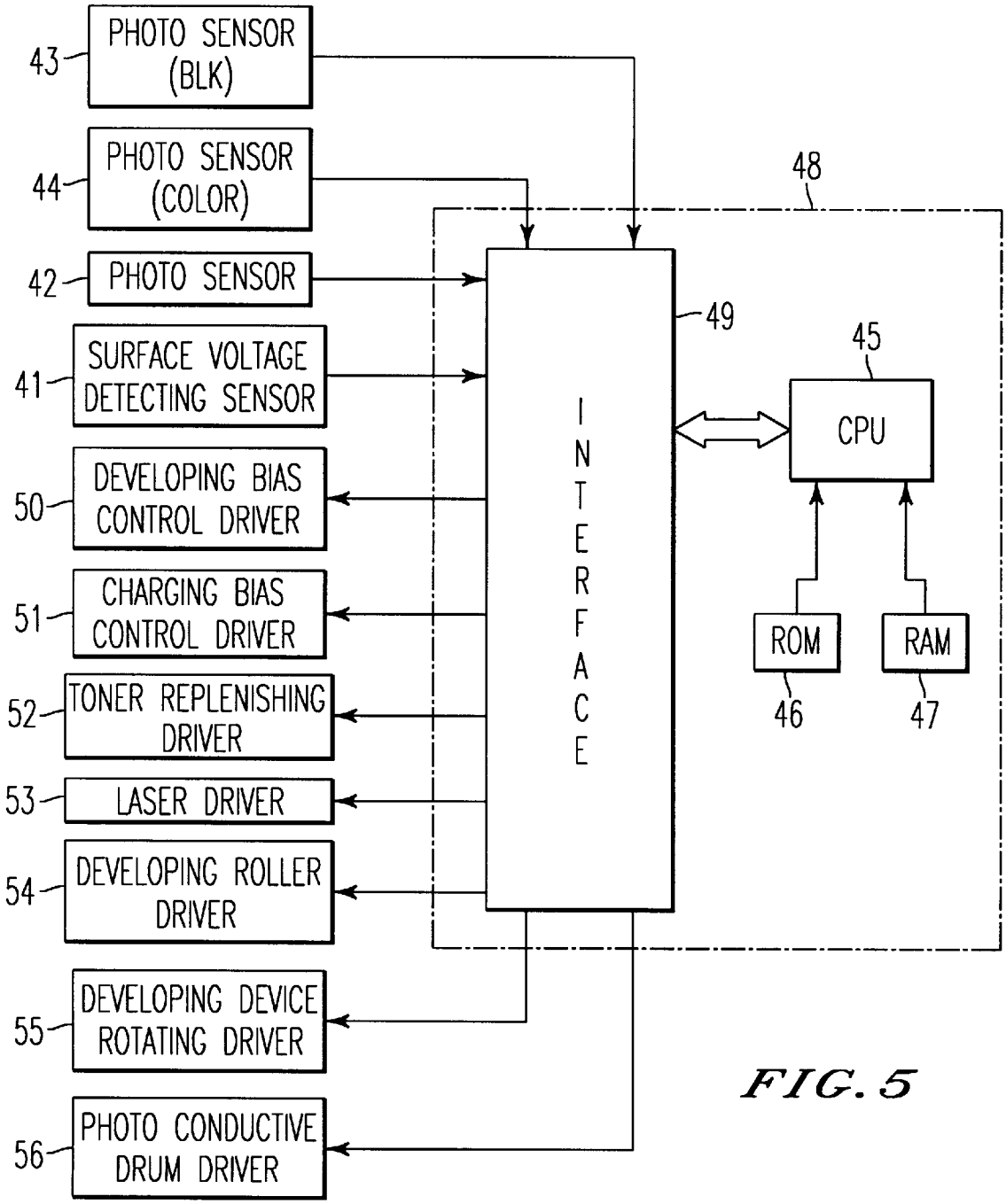
FIG. 5 is a block diagram of a control device of the present invention.

FIG. 5 shows a block diagram of a control device of the present invention. The surface voltage detecting sensor 41 which detects the surface voltage of the photoconductive drum 7 and the photo-sensor 42 are positioned around the photoconductive drum 7 (FIG. 1B). The photo-sensor 42 includes the light-emitting diode (LED) and the light receiving element. A photo-sensor 43 for detecting a black toner cartridge and a photo-sensor 44 for detecting a color toner cartridge are provided around the developing device 10. The system control unit 3 (FIG. 1A) includes a control device 48 having a central processing unit (CPU) 45 for performing processing operations, a read only memory (ROM) 46 which stores program and data for operation and processing, and a random access memory (RAM) 47 for storing data. Each component of the digital color copier is electrically connected to the CPU through an I/O interface 49. The scanner unit 1, the printer unit 2 and the paper feeder unit 4 are controlled by the control device 48. The CPU 45 controls the various components electrically connected thereto via the I/O interface 49. Input ports of the I/O interface 49 are connected to the surface voltage sensor 41, and the photo-sensors 42, 43 and 44. Output ports of the I/O interface 49 are connected to a developing bias control driver 50, a charging bias control driver 51, a toner replenishing driver 52, a laser driver 53, a developing roller driver 54, a developing device rotating driver 55 and a photoconductive drum driver 56. The toner replenishment operation is controlled by the control device 48. Namely, a reference toner image is formed on the surface of the photoconductive drum 7. The intensity of the reflected light from the reference toner image is detected by the photo-sensor 42. The control device 48 calculates the quantity of the reference toner image based on the intensity of the reflected light. The toner replenishing quantity is determined based on the quantity of the reference toner image, and the toner replenishing driver is driven to replenish toner.

Detection of Developing Ability

There are two types of reference toner images. One reference toner image is a twelfth gradual toner pattern for process control self-check mode and the other reference toner image is an intermediate gradual toner pattern for toner replenishing mode. During the process control self-check mode, the surface voltage of the photoconductive drum 7 is controlled. The process control self-check mode is operated when a power switch is turned on and the temperature of the fixing roller detected by a fixing temperature detecting sensor is less than 100° C. In addition, the process control self-check mode is operated when a predetermined number of copies are made. The intermediate gradual toner pattern is made each time the copying image is made on the photoconductive drum 7, and is made outside of the rear end of the image forming area on the photoconductive drum 7.

Figure 6:
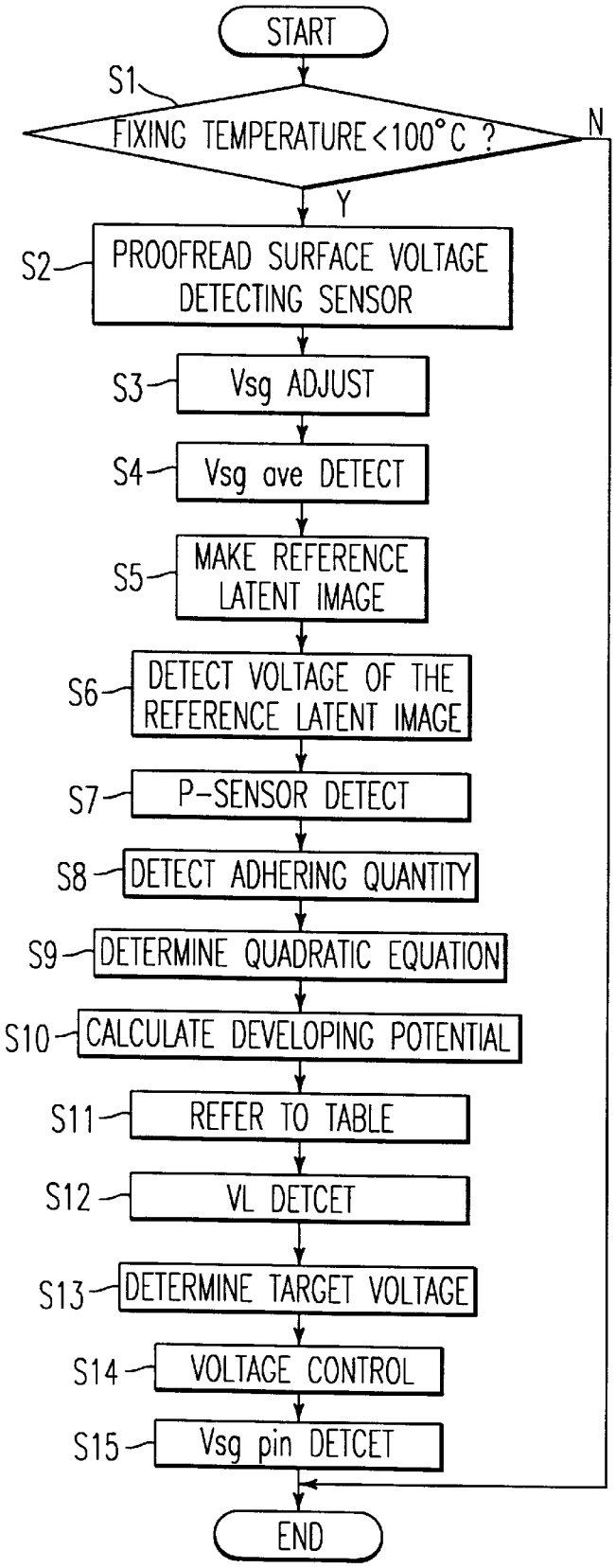
FIG. 6 is a flow chart describing the operation of controlling a voltage of process devices of the image forming apparatus.

FIG. 6 is a flow chart illustrating the process control self-check mode. A determination is made as to whether or not the temperature of the fixing roller detected by the fixing temperature detecting sensor is less than 100° C. (step S1). If the detected temperature of the fixing roller is not less than 100° C., the process control self-check mode is terminated (N in step S1). However, if the temperature of the fixing roller is less than 100° C. (Y in step S1), the surface voltage detecting sensor 41 is proofread (step S2). During the proofreading operation, the photocinductive drum 7 and the developing device 10 are not operated.

Next, at step S3, the emission intensity of the LED of the photo-sensor 42 is adjusted by detecting the intensity of the reflected light from the surface of the photoconductive drum 7 when no toner is adhered thereon if the photoconductive drum 7 and the image forming devices, such as the charger, the exposing device, the developing device and so on are in ideal condition. The intensity of the reflected light from the surface of the photoconductive drum 7 is represented by a voltage Vsg. In step S3, the LED emits the light onto the surface of the photoconductive drum 7 which rotates during the emission of the light in order to absorb a blur of the reflected light along the rotating direction of the photoconductive drum 7. The reflected light is detected by the light receiving element of the photo-sensor 42. The emission intensity of the LED is adjusted so that the intensity of the detected voltage is, for example, 4±0.1 (V).

When the reflected intensity (i.e., voltage Vsg) is detected, it is desirable that the developer on the developing sleeve 19 is away from the surface of the photoconductive drum 7 to prevent the toner from adhering the surface of the photoconductive drum 7. In this case, it is necessary that the developing sleeve 19 is not driven when the photoconductive drum 7 rotates. This is accomplished by driving the developing sleeve 19 independently from the photoconductive drum 7. However, fabrication costs increase if the developing sleeve and the photoconductive drum are driven by respective driving devices. On the other hand, if the developing sleeve 19 and the photoconductive drum 7 are driven by a single driving device, the developing sleeve 19 rotates when the photoconductive drum 7 rotates. In this case, the toner on the surface of the developing sleeve 19 easily adheres to the surface of the photoconductive drum 7 resulting in an error in the detected voltage corresponding to the intensity of the reflected light from the surface of the photoconductive drum 7.

According to the present embodiment, when the reflected intensity Vsg is detected only the DC bias voltage is applied to the developing sleeve 19 (i.e., the AC bias voltage is not also applied to the developing sleeve 19). In addition, if the DC bias voltage applied to the developing sleeve 19 is also reduced, toner on the developing sleeve 19 does not easily adhere to the surface of the photoconductive drum 7. However, if the DC bias voltage is decreased too much, carrier easily adheres to the surface of the photoconductive drum 7. Therefore, it is desirable that the DC bias voltage during the Vsg detecting operation is the same value when the copying operation is executed. When the toner is adhered on the surface of the drum 7, even though the AC bias voltage is not applied, the DC bias voltage is slightly decreased.

As previously discussed, when the copying operation is executed, the DC bias voltage superimposed on the AC bias voltage is applied to the developing sleeve 19. When the reference toner pattern is made, the same developing bias voltage as the copying operation is applied to the developing sleeve 19. Then the toner density of the reference toner pattern is detected by the photo-sensor 42. An average of the voltage Vsg (Vsg ave) is calculated at step S4. The LED of the photo-sensor 42 emits light and when a predetermined period of time, for example 3 seconds, passes, the detection of the reflected light from the surface of the photoconductive drum 7 starts. The reflected light is detected while the photoconductive drum 7 makes one revolution and the average of the intensity of the reflected light (Vsg ave) is calculated.

Figure 8:
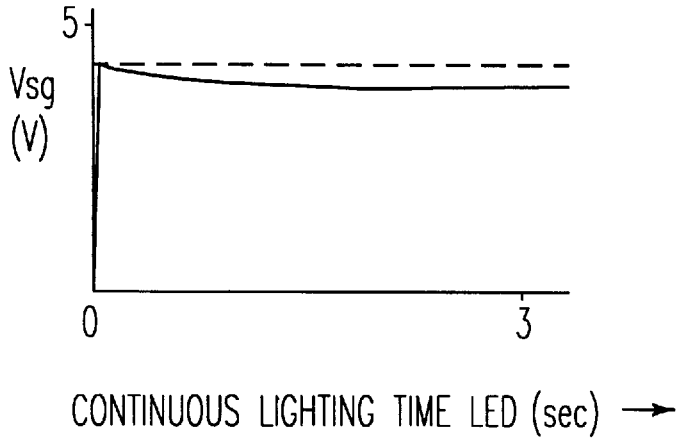
FIG. 8 is a graph showing a relationship between continuous lighting time and an output voltage of a photo-sensor.

FIG. 8 is a graph which shows a relationship between a continuous lighting time of the LED versus the voltage Vsg. Referring to FIG. 8, the voltage Vsg varies in response to the continuous lighting time. After the voltage Vsg reaches a maximum value, the voltage Vsg decreases since the emission intensity of the LED decreases. Namely, the internal temperature of the LED increases in response to emission of light. If the internal temperature increases, the internal resistance of the LED also increases and then the intensity of emission of the LED decreases. Therefore, the voltage Vsg decreases if the LED emits light for a long time. That phenomenon also occurs when the reflected light from the reference toner image is detected. According to the present embodiment, the voltage Vsg does not decrease after the LED has emitted light for 3 seconds as shown in FIG. 8. Accordingly, the detection of the reflected light from the surface of the photoconductive drum 7 is not started until after the LED has emitted light for 3 seconds. It is also possible to determine the detection timing of the reflected light in response to a specific characteristic of the LED.

Figure 9:
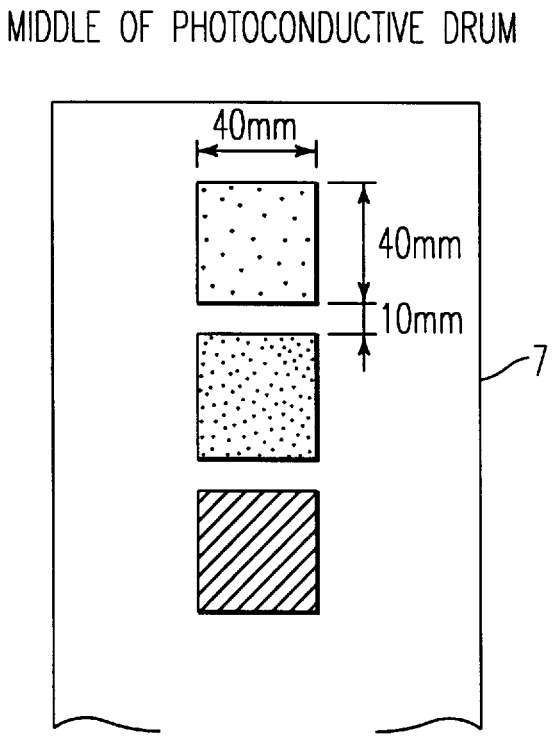
FIG. 9 shows reference toner density patterns.

Next, reference latent images are generated in step S5 such that electrostatic latent images having twelve gradual densities are formed on the photoconductive drum 7 by changing laser power one by one, for example, as shown in FIG. 9. In FIG. 9, twelve reference latent images are formed in the middle of and with respect to the longitudinal direction of the photoconductive drum 7. The surface voltage detecting sensor 41 detects the surface voltage of each reference latent image. The output of the sensor 41 is stored in RAM 47 (step S6).

In step S7, a density of each reference toner image (e.g., formed by developing each reference latent image) is detected by the photo-sensor 42. The output Vpi (i=1–N) of the sensor 42 is also stored in RAM 47. The steps S5 through S7 are performed four times in order to detect densities of the black image, the cyan image, the magenta image and the yellow image. It is also possible to make a number of gradual density images by changing a developing bias voltage instead of changing the laser power.

Figure 10:
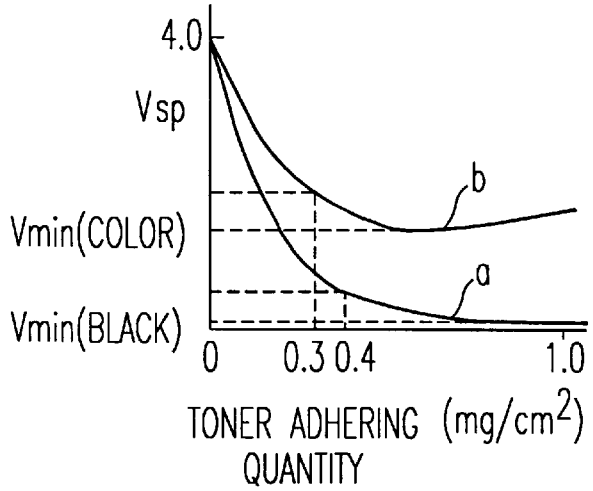
FIG. 10 is a graph showing a relationship between quantity of toner on a image bearing member and the output voltage of the photo-sensor.

In step S8, toner adhering quantity of each reference toner image is calculated. FIG. 10 is a graph which shows a relationship between a toner adhering quantity and an output voltage (Vsp) of the photo-sensor 42. In FIG. 10, curve a corresponds to a black reference toner image, and curve b corresponds to yellow, magenta and cyan reference toner images (i.e., color reference toner images). Dynamic range of the color referenced toner images is smaller than that of the black reference toner image where the dynamic range is defined as the difference between the voltages Vsg and Vmin (i.e., saturated value of the Vsp). Since the voltage Vmin varies in response to a scatter of the photo-sensor 42, the photoconductive drum 7 or the developing condition, the voltage Vsp is characterized by the following equation:

$$k=(Vsp-Vmin)/(Vsg-Vmin),$$

where k=0.00 to 1.00. A table indicating the relationship between the characterized value k and the toner adhering quantity is stored in the ROM 46. Toner adhering quantity per square area corresponding to the output value Vpi of the photo-sensor 42 is calculated by referring to the table and the calculated value stored in RAM 47 (step S8).

Figure 11:
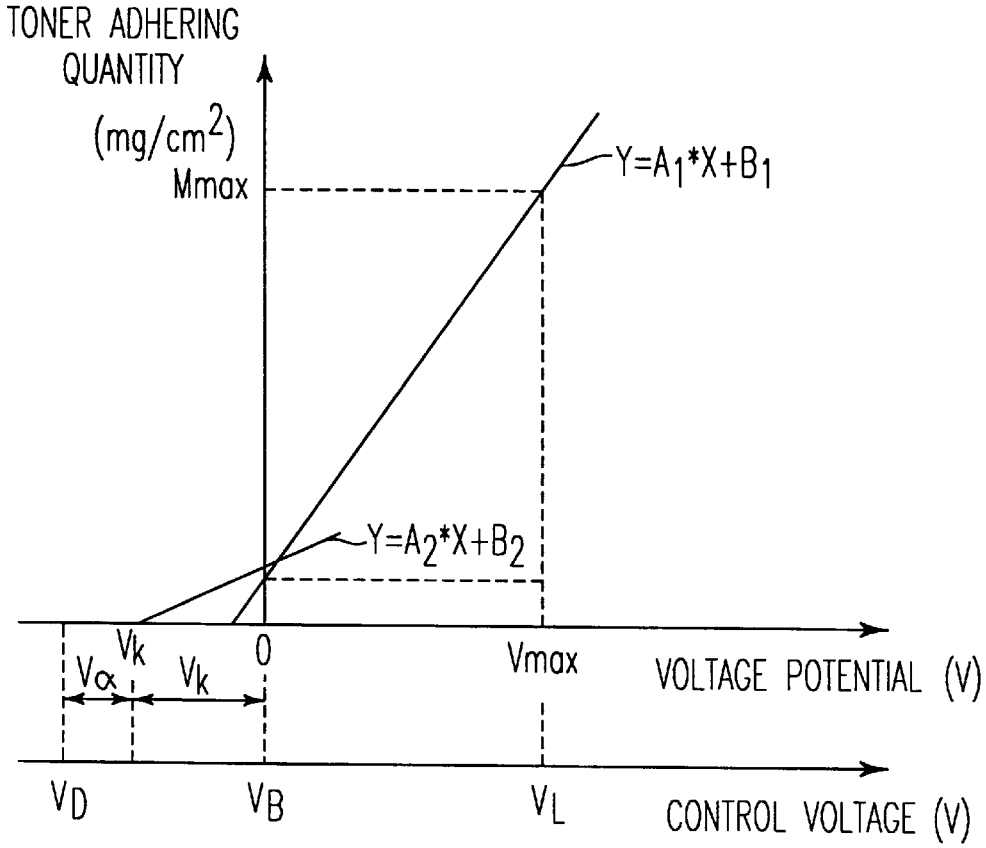
FIG. 11 is a graph showing a relationship between quantity of toner on a image bearing member and potential.

FIG. 11 is a graph which shows the relationship between the surface voltage detected by the operation in step S6 and the toner adhering quantity calculated by the operation in step S8. Referring to FIG. 11, the x-axis represents a voltage potential that is the difference between the developing bias voltage VB and the surface voltage VD of the photoconductive drum (i.e., VB–VD). The y-axis represents the toner adhering quantity per square area (i.e., M/A mg/cm$^2$). In step S9, a quadratic equation A (i.e., Y=(A1×X)+B1) is determined by using the output value of the surface voltage detecting sensor 41 and that of the photo-sensor 42. The quadratic equation A is determined as follows: First, five output values Xn of the surface voltage detecting sensor 41 and five output values Yn of the photo-sensor 42 are selected among the output Xn and the output Yn, where n=1 to 10. Namely, first set is Xn and Yn where n=1 to 5, second set is Xn and Yn where n=2 to 6, third set is Xn and Yn where n=3 to 7, fourth set is Xn and Yn where n=4 to 8 and fifth set is Xn and Yn where n=5 to 9 and sixth set is Xn and Yn where n=6 to 10. Then a straight-line approximation is performed by using the minimum square method and a correlation coefficient is calculated for each set (e.g., the first set (n=1 to 5), the second set (n=2 to 6), the third set (n=3 to 7), the fourth set (n=4 to 8), the fifth set (n=5 to 9) and the sixth set (n=6 to 10)). As a result, the following six quadratic equations and six correlation coefficients R are obtained:

$$Y=(A11\times X)+B11;R11$$

$$Y=(A12\times X)+B12;R12$$

$$Y=(A13\times X)+B13;R13$$

$$Y=(A14\times X)+B14;R14$$

$$Y=(A15\times X)+B15;R15$$

$$Y=(A16\times X)+B16;R16$$

The maximum correlation coefficient is selected from among the six correlation coefficients and the quadratic equation corresponding to the maximum correlation coefficient is determined as the quadratic equation A (i.e., Y=(A1×X)+B1).

Next, developing potential is calculated in step S10. Namely, the maximum voltage potential Vmax corresponding to the maximum adhering quantity Mmax is calculated based on the quadratic equation A. Then the developing bias voltage VB and the exposing voltage VL are calculated based on the maximum voltage potential Vmax by the following equations:

$$Mmax=(A11\times X)+B1$$

$$Vmax=(Mmax-B1)/A1$$

$$VB-VL=Vmax=(Mmax-B1)/A1$$

The relationship between a charging voltage VD charged by the charger 8 and the developing bias voltage VB is expressed by the following equation:

$$VD-VB=VK+V\alpha,$$

where VK is a developing start voltage that is an intersection point between the straight-line B corresponding a quadratic equation B (i.e., Y=(A2×X)+B2) and the x-axis, and Vα is a spare voltage level at which toner is not adhered to the area where the electrostatic latent image is not formed. The voltage Vα is obtained by experimnentation.

As a practical matter, the maximum voltage potential Vmax, the charging voltage VD, the developing bias voltage VB and the exposing voltage VL are stored in the ROM 57 as a table 57 as shown in FIG. 12. First, the maximum voltage potential Vmax is calculated and then the charging voltage VD, the developing bias voltage VB and the exposing voltage VL are obtained based on the voltage Vmax by using the table 57 (steps S11 and S12). Then laser light having the maximum intensity is emitted on the surface of the photoconductive drum 7 and then the voltage on the photoconductive drum 7 is detected by the surface voltage detecting sensor 41. If the surface voltage detecting sensor 41 detects some voltage that is a residual voltage of the photoconductive drum 7, each charging voltage VD (i.e., the developing bias voltage VB and the exposing voltage VL) is compensated for the residual voltage. Each compensated voltage is used as a target voltage (step S 13). The charger 8 is controlled such that the charged voltage VD on the surface of the photoconductive drum 7 coincides with the target voltage (step S14). After the charged voltage coincides with the target value, the laser power is controlled such that the exposed voltage VL coincides with a target voltage (step S14).

Intensity Vsg ptm of the reflected light from the surface of the photoconductive drum 7 is detected in step S15. The voltage Vsg ptn is detected when, the intermediate mode, the toner replenishing mode is operated. As mentioned above, the intermediate gradual toner pattern for the toner replenishing mode is made each time the copying image is made on the photoconductive drum 7. On the other hand, the Vsg ave is detected after the LED has emitted light for 3 seconds. Since the Vsg ptn is detected each time the copying image is made on the photoconductive drum 7, if the LED has emitted light for 3 seconds each time the copying image is made, the photoconductive drum 7 and the LED become weak for a short time. Further, the emitted light from the LED reaches a toner image forming area on the surface of the photoconductive drum 7 and an electrical charge of toner is discharged. As a result, the discharged toner does not easily transfer from the photoconductive drum 7 to the intermediate transfer belt 11. Therefore, it is impossible that the LED has emitted light for 3 seconds when the Vsg ptn is detected during the toner replenishing mode. The time period of emitting light of the LED before detecting the Vsg ptn is shorter than detecting the Vsg ave. As a result, the detected value Vsg is changed in response to the continuous lighting time of the LED.

In order to compensate for the change of the voltage Vsg in response to the continuous lighting time of the LED, the image forming condition to detect the voltage Vsg ptn (e.g., the charging voltage of the charger 8 and the developing bias voltage VB and so on) is set to be the same when the voltage Vsg ave is detected. In order to detect accurate toner adhering quantity of the intermediate gradual toner pattern for the toner replenishing mode, it is necessary that the voltage Vsp is referenced based on the voltage Vmin that is detected in step S8. However, since the voltage Vsg ave is lower than the voltage Vsg ave corresponding to the continuous lighting time of the LED, the saturated value corresponding to the voltage Vsg ptn is different from the voltage Vmin corresponding to the voltage Vsg ave. Therefore, it is necessary to compensate the voltage Vmin based on the voltages Vsg ptn and Vsg ave. The voltage Vmin is compensated according to the following equation:

$$Vmin\ pth=Vmin\times Vsg\ ptn/Vnsg\ ave,$$

where the voltage Vmin pth is the compensated saturated value corresponding the voltage Vsg ptn.

Figure 7:
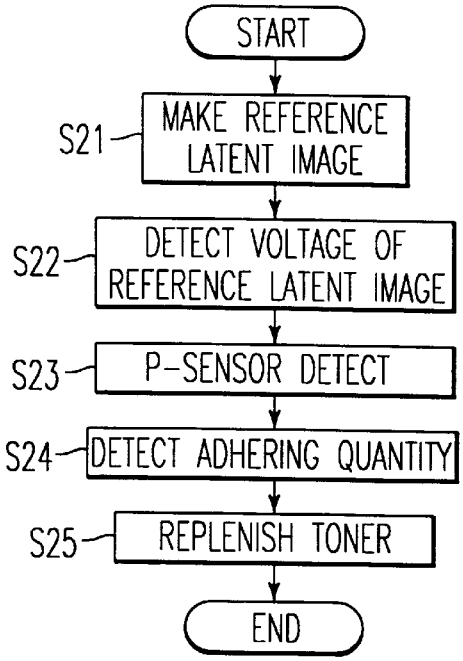
FIG. 7 is a flow chart describing the operation of controlling replenishment of toner.

FIG. 7 is a flow chart illustrating the operation for controlling replenishment of toner. Referring to FIG. 7, the intermediate gradual latent image is formed on the surface of the photoconductive drum 7 and then the voltage of the intermediate gradual latent image is detected by the surface voltage detecting sensor 41 (step S21). The detected voltage is stored in the RAM 47 (step S22). The intermediate gradual latent image is developed by the developing device 10 by applying a developing bias voltage by adding a predetermined voltage, for example 130V, to the voltage stored in the RAM 47 to make the reference toner pattern. The density of the reference toner pattern is detected by the photo-sensor 42 (step S23). The detected voltage Vsp pth is characterized by the following equation:

$$k=(Vsp\ pth-Vmin\ pth)/(Vsg\ ptn-Vmin\ pth)$$

As mentioned above, since the time period of emitting light of the LED before detecting the reference toner pattern for the toner replenishing mode is shorter than that for the process control self-check mode, the intensity of the emitting light of the LED for the toner replenishing mode is stronger than that for the process control self-check mode. As a result, the voltage Vsp pth is bigger than the voltage Vsp due to the continuous emitting light time. Therefore, it is essential to compensate the voltage Vmin in response to the voltage Vsg ptn to accurately detect the toner adhering quantity.

Then toner replenishing quantity is determined based on the calculated value k above and a predetermined value and the toner replenishing driver 52 is driven to replenish toner (step 25). It is also possible to form the images which are detected by the photo-sensor 42 on the intermediate transfer belt 11 instead of the photoconductive drum 7.

Although in the preferred embodiment the control device 48 includes the CPU 45, the ROM 46, the RAM 47 and the I/O interface 49, this invention may be implemented using a conventional general purpose digital computer or microprocessor programmed according to the teachings of the present specification, as will be apparent to those skilled in the computer art. Appropriate software coding can readily be prepared by skilled programmers based on the teachings of the present disclosure, as will be apparent to those skilled in the software art. The invention may also be implemented by the preparation of application specific integrated circuits or by interconnecting an appropriate network of conventional component circuits, as will be readily apparent to those skilled in the art.

The present invention includes a computer program product (e.g., implementing the flow charts of FIGS. 6 and 7) which may be on a storage medium including instructions which can be used to program the CPU 45 to perform a process of the invention. The storage medium can include, but is not limited to, any type of disk including floppy disks, optical discs, CD-ROMs, and magneto-optical disks, ROMs, RAMs, EPROMs, EEPROMs, magnetic or optical cards, or any type of media suitable for storing electronic instructions.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An image forming apparatus, comprising:

an image bearing means;

means for forming an image on the image bearing means;

means for emitting light on image formed on the image bearing means;

means for receiving reflected light from the image formed on the image bearing means;

means for detecting the intensity of the reflected light from the image formed on the image bearing means;

means for compensating the detected intensity based on a continuous lighting time of the emitting means; and means for controlling the image forming means in response to the compensated detected intensity.

2. The apparatus as claimed in claim 1, wherein the image bearing means is a photoconductive element.

3. The apparatus as claimed in claim 2, wherein the image forming means includes a developing device for developing an electrostatic latent image on the image bearing means, and the detecting means detects a first intensity corresponding to reflected light from a surface of the photoconductive element where toner is not adhered thereon if the photoconductive element and the image forming means are in an ideal condition, a second intensity corresponding to reflected light from a referenced toner image formed on the photoconductive element, and a saturated value of the second intensity.

4. The apparatus as claimed in claim 3, wherein the detecting means generates a reference value corresponding to the saturated value based on the first and second intensities.

5. The apparatus as claimed in claim 4, wherein the image forming means includes a charger for charging the surface of the photoconductive element, an exposing device for exposing the charged surface to form an electrostatic latent image thereon and a developing device for developing the electrostatic latent image.

6. The apparatus as claimed in claim 5, further comprising:

means for controlling at least one of the charger, the exposing device and the developing device in response to the referenced value.

7. The apparatus as claimed in claim 4, further comprising:

a toner replenishing device; and a driver which drives a toner replenishing device;

wherein the controlling means controls the driver in response to the compensated detected intensity.

8. The apparatus as claimed in claim 3, further comprising:

a developing bias voltage control device for controlling a developing bias voltage such that when a toner image which is to be formed on the sheet of paper is formed on the phot-conductive element, an AC bias voltage superimposed with a DC bias voltage is applied to the developing device and when the detecting means detects the reflected light from the surface of the photoconductive element, the DC bias voltage is applied to the developing device.

9. An image forming apparatus, comprising:

an image bearing means;

means for forming a first image and a second image which is different from the first image on the image bearing means;

means for emitting light on the first image and the second image in which continuous lighting times applied by the emitting means to the first image and to the second image are different from each other;

means for receiving reflected light from the first image and from the second image;

means for detecting first and second intensities corresponding to the reflected light from the first and second images, respectively;

means for compensating the second detected intensity based on the continuous lighting time of the emitting means; and means for controlling the image forming means in response to the first intensity and the compensated second intensity.

10. The apparatus as claimed in claim 9, wherein:

image forming conditions of the image forming means for forming the first and second images are the same.

11. An image forming apparatus, comprising:

an photocondutctive member;

an image forming device which forms an image on the photocondutctive member;

a photo-sensor including light a emitting diode which emits light to and receives reflected light from the photocondutctive member;

circuitry which compensates an intensity value detected by the photo-sensor based on a continuous lighting time of the light emitting diode; and a controller which controls the image forming device in response to the compensated intensity value.

12. The apparatus as claimed in claim 11, wherein the image forming device includes a charger for charging a surface of the photoconductive member, an exposing device for exposing the charged surface to form an electrostatic latent image thereon, and a developing device for developing the electrostatic latent image on the photoconductive member, and the photo-sensor detects a first intensity corresponding reflected light from the surface of the photoconductive member where toner is not adhered thereon if the photoconductive member and the image forming device are in ideal condition, a second intensity from reflected light from a reference toner image formed on the photoconductive member, and a saturated value of the second intensity.

13. The apparatus as claimed in claim 12, further comprising:

second circuitry which generates a reference value corresponding to the saturated value based on the first and second intensities.

14. The apparatus as claimed in claim 13, further comprising:

second controller which controls at least one of the charger, the exposing device and the developing device in response to the reference value.

15. The apparatus as claimed in claim 13, further comprising:

a toner replenishing device; and a driver which drives the toner replenishing device;

wherein the controller controls the driver in response to the compensated intensity value.

16. The apparatus as claimed in claim 12, further comprising:

a developing bias voltage control device for controlling the developing bias voltage such that when a toner image which is to be formed on a sheet of paper is formed on the photoconductive member, an AC bias voltage superimposed with a DC bias voltage is applied to the developing device and when the photo-sensor detects the reflected light from the surface of the photoconductive member, the DC bias voltage is applied to the developing device.

17. An image density control method, comprising the steps of:

forming an image on an image bearing device;

emitting light on the image formed on the image bearing device;

receiving reflected light from the image formed on the image bearing device;

detecting an intensity of light reflected from the image formed on the image bearing device;

compensating the detected intensity based on a continuous lighting time of the emitted light and generating a compensated value; and controlling an image formation on the image bearing device in response to the compensated value.

18. A computer program product, comprising:

a computer storage medium and a computer program code mechanism embedded in the computer storage medium for causing a computer to control an image density, the computer program code mechanism comprising:

a first computer code segment configured detect an intensity of light reflected from an image formed on an image bearing device by an image forming device;

second computer code segment configured to compensate the detected intensity based on a continuous lighting time of light emitted from the image formed on the image bearing device and to generate a compensated value; and a third computer code segment configured to control the image formation on the image bearing device in response to the compensated value.

* * * * *